US005957065A

United States Patent [19]

Hough et al.

[11] Patent Number: 5,957,065

[45] Date of Patent: Sep. 28, 1999

[54] CREMATORS

[75] Inventors: Edward Lee Hough; Edward Hough, both of Stockport, United Kingdom

[73] Assignee: Cremation Technology International Ltd., Cheshire, United Kingdom

[21] Appl. No.: 08/846,152

[22] Filed: Apr. 25, 1997

[30] Foreign Application Priority Data

May 1, 1996 [GB] United Kingdom ..... 9609151

[51] Int. Cl.[6] ..... F23G 1/00

[52] U.S. Cl. ..... 110/194; 110/212; 110/235

[58] Field of Search ..... 110/194, 211, 110/212, 235

[56] References Cited

U.S. PATENT DOCUMENTS

| | | | |
|---|---|---|---|
| 3,875,874 | 4/1975 | Altmann . | |
| 4,123,979 | 11/1978 | Tesch . | |
| 4,603,644 | 8/1986 | Brookes | 110/194 |
| 5,161,966 | 11/1992 | Obermueller | 110/211 X |
| 5,317,978 | 6/1994 | Alexandersson | 110/212 X |
| 5,516,499 | 5/1996 | Pereira et al. | 110/211 X |

FOREIGN PATENT DOCUMENTS

| | | |
|---|---|---|
| 0 114 587 | 8/1984 | European Pat. Off. . |
| 0 512 353 | 11/1992 | European Pat. Off. . |
| 89/09912 | 10/1989 | WIPO . |

OTHER PUBLICATIONS

Patent Abstract of Japan—vol. 095, No. 011, Dec. 26, 1995, and JP 07 198122 A (Daiwa Plant Kensetsu KK), Aug. 1, 1995.

Patent Abstract—vol. 71, No. 843, Oct. 1, 1990, p. 62 XP000161098, "Tough Regulations Expected For Incinerators".

Patent Abstract of Japan—vol. 008, No. 064 (M–285), Mar. 27, 1984 and JP 58 214709 A (Taiyou Chikuro Kogyo KK), Dec. 14, 1983.

*Primary Examiner*—Henry A. Bennett
*Assistant Examiner*—Susanne C. Tinker
*Attorney, Agent, or Firm*—Alston & Bird LLP

[57] ABSTRACT

A cremator comprises a primary combustion chamber for receiving through a charge door thereof a coffin or other object to be cremated and being provided with a first burner, a secondary combustion chamber (e.g. in the form of a tube of thermally conductive material) in communication with the primary combustion chamber and being provided with a second burner, and a retention chamber in communication with the secondary combustion chamber for temporarily retaining heated waste gases exhausted from the secondary and primary combustion chambers before passing to a waste flue, characterised in that at least a portion of the secondary combustion chamber is located within the retention chamber, whereby gases retained in the retention chamber are heated (preferably to a temperature of at least 850° C.) at least partly by direct heating from the secondary combustion chamber. This improved constructional design provides for a more compact and fuel-efficient dual combustion chamber-type cremator.

8 Claims, 3 Drawing Sheets

CREMATORS

FIELD OF THE INVENTION

This invention relates to cremators, more particularly to improvements in cremators of the type comprising primary and secondary combustion chambers.

BACKGROUND OF THE INVENTION AND PRIOR ART

As used herein, the term "cremator" is intended to include incinerators and other furnaces for burning objects and materials other than coffins, e.g. any form of waste, or even other materials or objects, and the term should therefore be construed accordingly.

There are various known designs of cremators of the type having a primary combustion chamber for receiving through a charge door thereof a coffin or other object for cremating by means of a burner directed into the primary combustion chamber, and a secondary combustion chamber, separate from the primary combustion chamber, through which are passed the gases, particulates and other exhaust materials from the primary combustion chamber to ensure maximum burning of combustible material during the cremation process. One example of such a dual combustion chamber furnace is disclosed in our published UK patent application GB-A-2180630.

Such dual combustion chamber furnaces are advantageous over known single combustion chamber furnaces, because of the higher degree of burn-off of combustible material from the coffin or other object being cremated. In fact, nowadays such dual combustion chamber cremators are generally essential in order to satisfy legal, environmental and aesthetic requirements as regards waste emissions from cremator installations.

Over recent years in many countries of the world legislation has been introduced which places even more stringent requirements on the content of waste gases emitted from cremator installations, particularly with respect to ensuring complete combustion of gases and fine particulates entrained therein exiting from the combustion chamber(s) before being released from the cremator via an exhaust flue. Laws now generally required that the waste gases exhausted from the combustion chamber(s) are retained in a retention zone heated to a temperature of at least 850° C. (as is the case in Europe) for a period of at least two seconds, before being allowed to pass to the exhaust flue and released into the atmosphere. This period of retention of the waste gases in the heated retention zone ensures complete combustion of gases and any remnant or fine particles entrained therein which may not have been fully burned during the main combustion process.

There have been various known attempts at designing cremator furnaces which include such a heated retention zone in addition to the preferred primary and secondary main combustion chambers. Once such known design of cremator is shown in FIGS. 1A and 1B of the accompanying drawings. Here the cremator comprises a main, primary combustion chamber C1 into which may be loaded via charging door D1 a coffin or other object to be cremated. The primary combustion chamber C1 has a first burner/air inlet jet B1 by means of which the coffin undergoes primary combustion. Located beneath the primary combustion chamber C1 is a secondary combustion chamber C2 which is provided with a second burner/air inlet jet B2 to accomplish secondary combustion of waste gases and gas-born material exhausted from the primary combustion chamber C1. In this particular example the cremator has an additional, tertiary, combustion chamber C3, again with its own, third, burner/air inlet jet B3 which is located beneath the secondary combustion chamber C2. All three combustion chambers C1, C2 and C3 are typically heated by their respective burners to up to around 1300° C. The arrows in FIGS. 1A and 1B illustrate schematically the general path of waste gases within the cremator.

Having passed from the primary combustion chamber C1 through the secondary and tertiary combustion chambers C2 and C3, the waste gases pass up and through ducts around the primary combustion chamber C1 into a retention chamber R which is located above the primary combustion chamber C1. The gases remain in this retention chamber R for a short period of time before passing up and out thereof via exhaust flue F. The temperature of the retention chamber R is maintained at the required level (e.g. at least 850° C.) either by the temperature of the waste gases themselves or, if necessary, by use of an additional burner (not shown) provided in the retention chamber itself. It can generally be considered that in this known construction of cremator, it is the secondary and tertiary combustion chambers C2, C3 as well as the retention chamber R itself which together constitute the heated retention zone which by law is required to be present.

This known construction of cremator has several disadvantages: one is that each chamber or region through which waste gases pass is discrete and provided with its own respective burner. This leads to uneconomical use of fuel and power and also demands a more complex operating control system for the whole apparatus. The cremator of this design is also bulky and necessarily of more complex and costly construction.

In another known cremator design which employs a retention chamber to temporarily accommodate waste gases having been exhausted from the main combustion chamber (s), the retention chamber is located not above the main combustion chamber, but alongside it. This construction of cremator leads to similar disadvantages as regards economy of operation, bulkiness, complexity, cost, as the first known design of cremator discussed above.

SUMMARY OF THE INVENTION

It is an object of the present invention to provide a new construction of cremator which ameliorates the above discussed problems associated with known cremators which include a retention chamber, and to provide a cremator which is of simpler and cheaper construction, is more compact, and is more economical to run.

According to the present invention there is provided a cremator comprising a primary combustion chamber for receiving through a charge door thereof a coffin or other object to be cremated and being provided with a first burner, means defining a secondary combustion chamber in communication with the primary combustion chamber and being provided with a second burner, and a retention chamber in communication with the secondary combustion chamber for temporarily retaining waste gases exhausted from the secondary and primary combustion chambers before passing to a waste flue, characterised in that at least a portion of the means defining the secondary combustion chamber is located within the retention chamber, whereby gases retained in the retention chamber are heated at least partly by direct heating from the means defining the secondary combustion chamber.

In preferred embodiments of the invention the means defining the secondary combustion chamber is in the form of a tube which is mounted with one end in communication with the primary combustion chamber and the opposite, preferably open, end opening into the retention chamber, with at least a major proportion of the tube being located within the retention chamber. The tube is made of a material which is a good heat conductor, so that heat generated within the secondary combustion chamber is used to heat, at least by means of conduction and/or radiation, the interior of the retention chamber and thereby the waste gases temporarily retained therein.

A suitable heat conducting material for the secondary combustion tube is silicon carbide, which has high heat conductivity and also high strength and gas impermeability over long periods at elevated temperatures. Other heat conducting materials may also be suitable, e.g. certain metals or metal alloys.

Preferably the interior of the retention chamber is maintained at a temperature of at least about 850° C., although this figure may vary depending upon legal or technical requirements.

For best results and economics of operation of the cremator, the retention chamber is preferably located above the primary combustion chamber, with the secondary combustion tube being supported at one end thereof such that substantially the whole length of the tube is located within the retention chamber in order to maximise the use of heat generated within it to heat the waste gases temporarily retained in the retention chamber.

In order to aid the passage of waste gases exhausted from the secondary combustion chamber through the retention chamber with the required retention time, which is typically of the order of two seconds (but may for example be anything from 1 to 5 seconds, for example), the retention chamber may in preferred embodiments of the invention be provided with air inlet means via which clean air may be introduced into the retention chamber to promote and/or control throughflow of the waste gases through the retention chamber. The air introduced into the retention chamber may advantageously be at a temperature selected such as to permit control of the mean temperature of the waste gases whilst in the retention chamber in order to satisfy the legal requirements of minimum temperature therein.

By designing a cremator or similar furnace in accordance with the present invention, by locating the secondary combustion chamber within the retention chamber so that the secondary combustion chamber constitutes the means by which the retention chamber is heated, it is possible to achieve the recognised advantages of having a retention chamber itself and to satisfy the increasingly widespread legal requirements associated therewith, whilst keeping the number of burners to a minimum, leading to reduced consumption of fuel and simplifying the control system of the cremator, whilst also producing a more compact installation.

DETAILED DESCRIPTION OF A PREFERRED EMBODIMENT

A preferred embodiment of the present invention will now be described in detail, with reference to the accompanying drawings, in which.

Figure 1A:
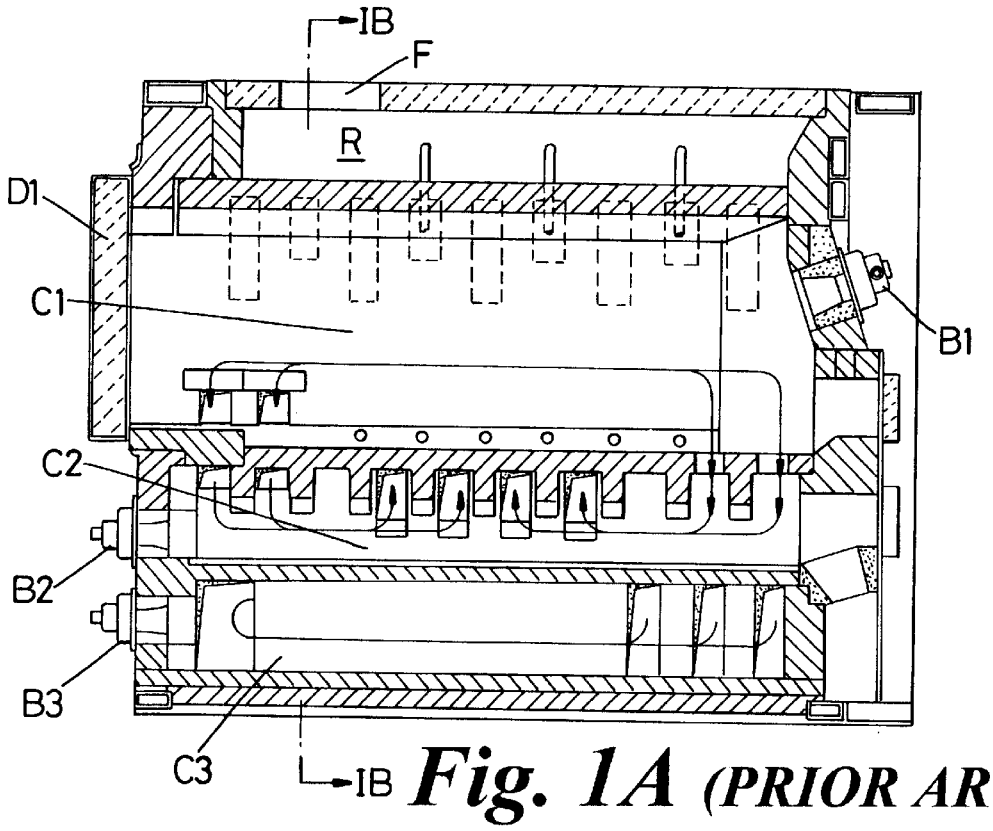
Fig. 1A (PRIOR ART)
FIGS. 1A and 1B are, respectively, side elevational and front elevational cut-away views of a known cremator according to the prior art, which has already been described.
Figure 1B:
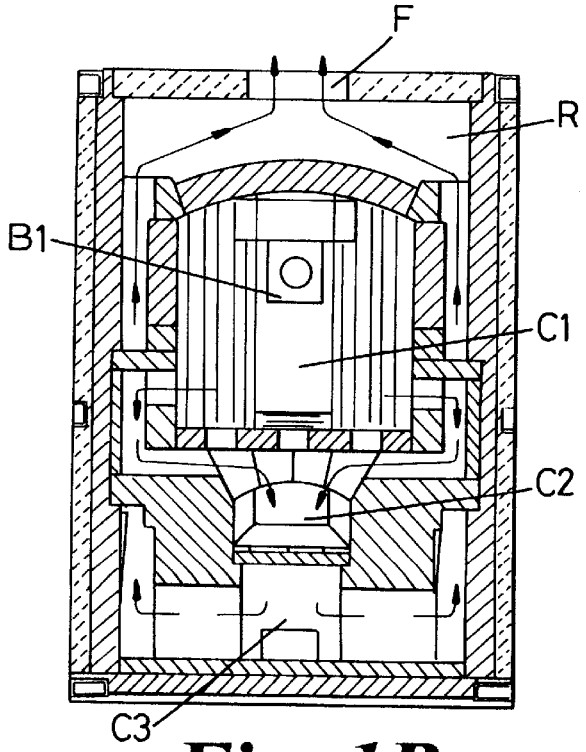
Fig. 1B (PRIOR ART)
Figure 2:
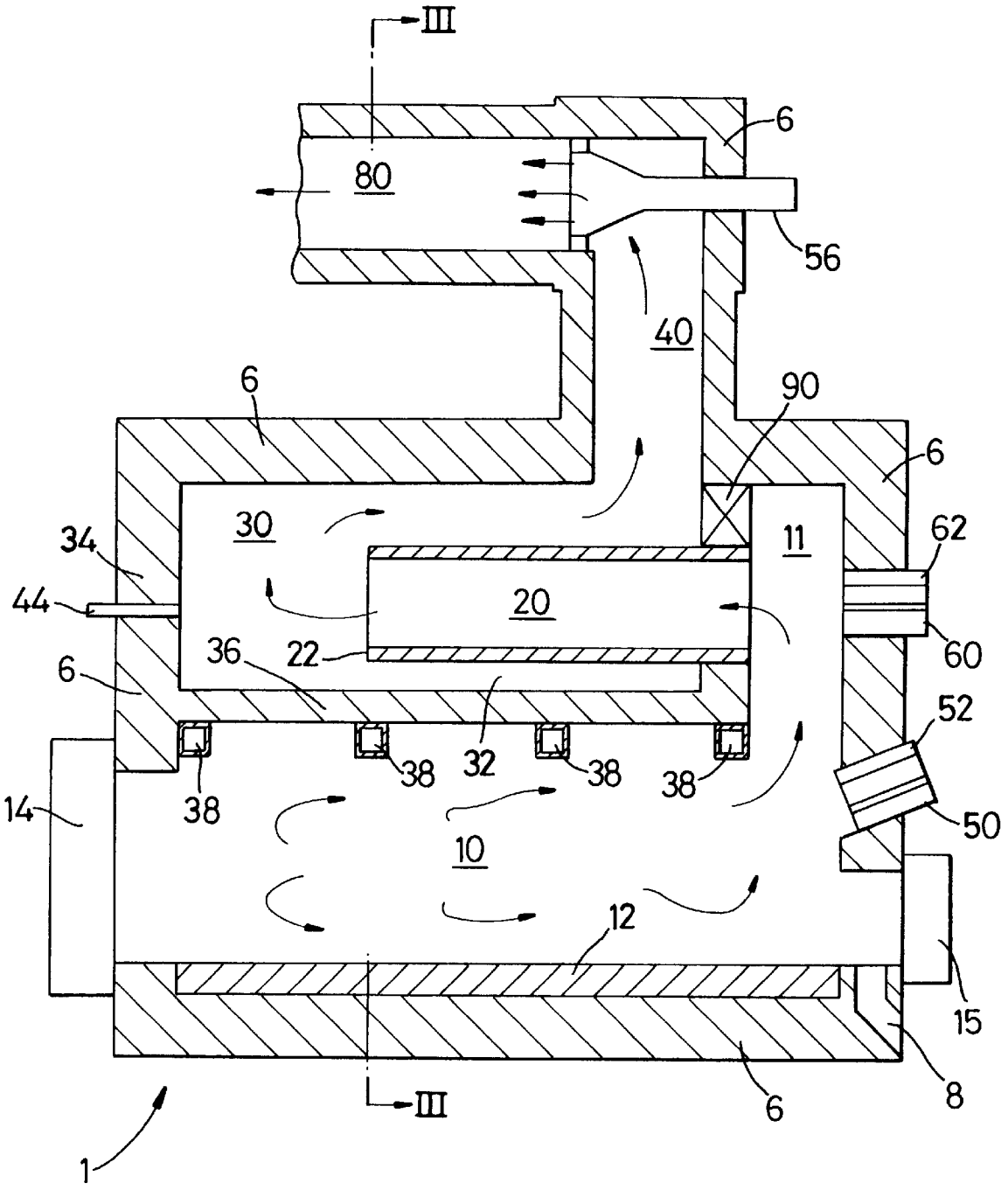
FIG. 2 is a side elevational cut-away view of a cremator according to the preferred embodiment of the invention.
Figure 3:
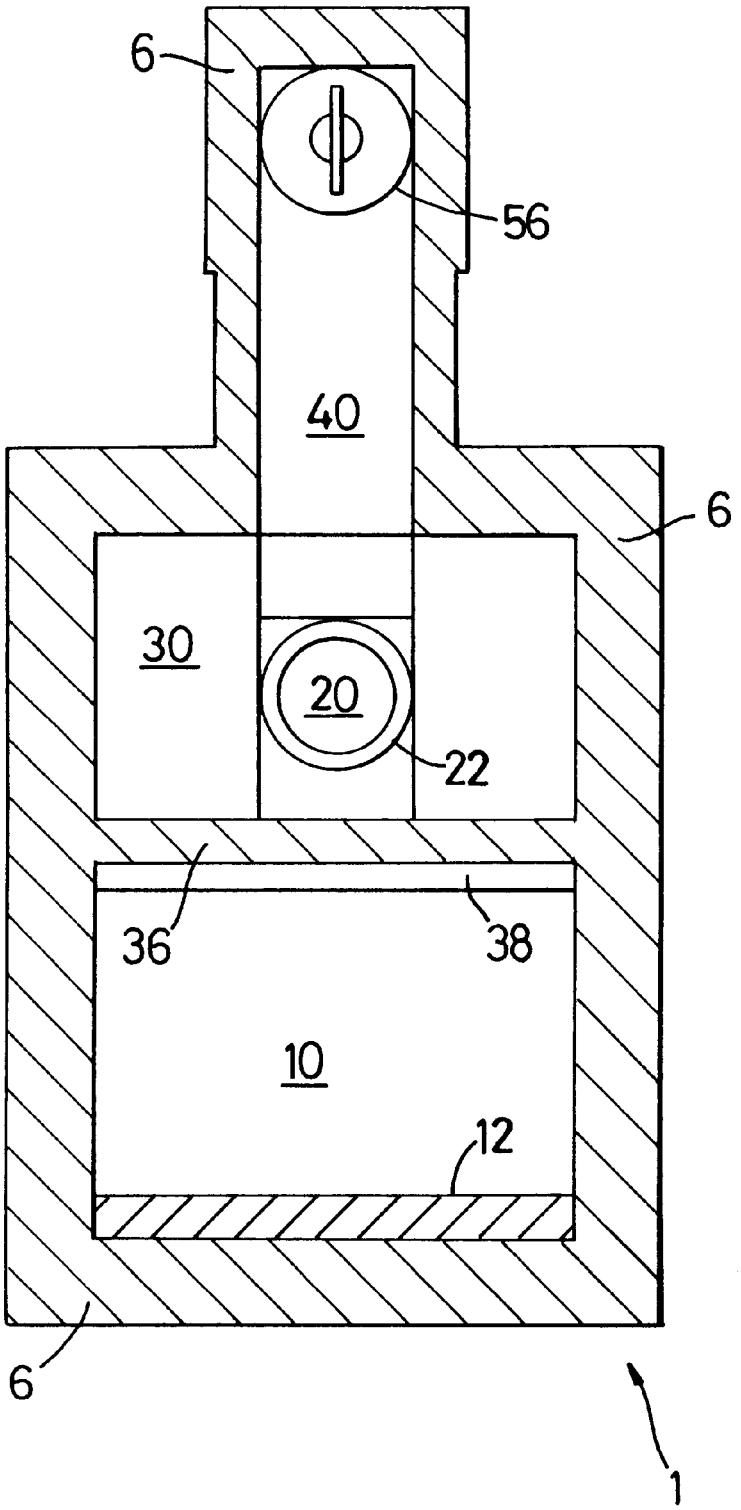
FIG. 3 is a front elevational cut-away view of the cremator of FIG. 2.

Referring to FIGS. 2 and 3, cremator 1 comprises a primary combustion chamber 10, a secondary combustion chamber 20 and a retention chamber 30. The primary combustion chamber 10 is provided with a first burner 50 and associated first air inlet jet 52, by means of which a coffin or other object loaded into the primary combustion chamber 10 through charging door 14 is burnt. The general construction of the primary combustion chamber 10, including hearth 12, rear door 15 for raking-out, cleaning, etc., and outlet chute 8 for removal of solid cremation products, is substantially the same as in known types of cremator, particularly for example as disclosed in our published UK patent applications nos. GB-A-2052700 and GB-A-2180630, the disclosures of both of which references are incorporated herein by reference.

Located generally above the primary combustion chamber 10 and separated therefrom by dividing wall 36 is retention chamber 30, which in normal sized cremator installations will typically have a volume of about 2.5 $m^3$ (90 cubic feet). The dividing wall 36 is supported by cross-beams 38, which may be of any suitable size, number and material, as is already known in the art of existing cremators.

Within retention chamber 30 is mounted secondary combustion chamber 20 which is in the form of a cylindrical tube of silicon carbide. For a retention chamber of the above generally preferred volume, the secondary combustion tube 20 will typically have a volume of around 0.08 $m^3$ (3 cubic feet, this being counted as part of the above total retention chamber volume), with a wall thickness of from about 2 to 8 cm, an internal diameter of the order of from about 20 to 30 cm, and a length of the order of from about 50 to 150 cm. The secondary combustion tube 20 is mounted in a wall portion of the cremator casing and thereby supported so that substantially the whole operative length of the tube (e.g. at least 80 or 90% of its total length) is located within the retention chamber 30 and spaced above the dividing wall 36 by a gap 32 of a few centimetres (e.g. from about 2 to 10 cm). This gap enables waste gases in the retention chamber 30 to circulate around and surround the secondary combustion tube 20 and be evenly heated thereby.

The secondary combustion tube 20 is provided with second burner 60 and associated air inlet jet 62, which second burner arrangement ensures as far as possible 100% combustion within the secondary combustion tube 20 of gases, particulates and other remnant combustible matter carried in the waste gases exhausted from the primary combustion chamber 10. In FIG. 2 the general direction of circulation of gases within the cremator is indicated by arrows.

The temperature at which the primary and secondary combustion chambers 10 are operated will typically be of the order of up to 1300° C. as is generally the case with known cremator designs. As hot waste gases from primary combustion chamber 10 pass up and out thereof and into secondary combustion tube 20 via mixing chamber 11, intimate mixing of the exiting gases and incoming air from the second burner arrangement 60, 62 occurs, which promotes optimum secondary combustion within the secondary combustion chamber 20. In preferred constructions of the cremator shown in FIG. 2, a safety bypass valve or equivalent means 90 may be provided, in the event that diversion of waste gases so as to bypass the retention chamber 30 is required for any reason.

The secondary combustion tube 20 is preferably open-ended opposite the end via which it is mounted and supported in the cremator casing and from here the waste gases pass into the retention chamber 30, remain therein typically for a period of two seconds before passing up and out therefrom into waste flue 80 via waste gas flue collection box 40.

The retention time of the waste gases in the retention chamber 30 is controlled by controlling the throughflow rate of waste gases, as is already known in principle in the art. This may be achieved principally by damper and cold air inlet means 56 in the exit flue 80 and may additionally be controlled by the introduction of clean air into the retention chamber 30 via retention chamber air inlet 44.

This air inlet 44 serves another important purpose, namely to promote the 180° turn-around in the direction of gas flow between the secondary combustion chamber 20 and its exit from the retention chamber 30 into the flue collection box 40. This sudden about-turn of hot waste gases may typically cause erosion of the back wall 34 of the retention chamber 30, and the introduction of air which is at a lower temperature than the interior temperature of the retention chamber 30 assists in minimising such erosion.

The temperature of incoming air via retention chamber air inlet 44 is also used to control the average temperature of the retention chamber 30, which under European legislation is typically held at at least 850° C. (Higher retention chamber temperatures than this are legally required are economical.) This temperature is maintained by the constant heating of the waste gases in the retention chamber 30 by the heat-conductive material of the secondary combustion tube 20 which is located therein.

The general construction of the frame, outer casing 6 and supporting base (not shown) of the cremator of the illustrated embodiment of the invention is substantially as is well known and conventional in the cremator art, and so will not be described in further detail here.

It is to be understood that the embodiment of the present invention described above is by way of example only and various obvious modifications will be apparent to persons skilled in the art, yet still within the scope of the present invention as defined by the claims.

What is claimed is:

1. A cremator comprising a primary combustion chamber for receiving through a charge door thereof a coffin or other object to be cremated and being provided with a first burner, means defining a secondary combustion chamber in communication with the primary combustion chamber and being provided with a second burner, and a retention chamber in communication with the secondary combustion chamber for temporarily retaining waste gases exhausted from the secondary and primary combustion chambers before passing to a waste flue, characterized in that at least a portion of the means defining the secondary combustion chamber comprises a tube having one end in communication with the primary combustion chamber and the opposite end opening into the retention chamber, with at least a major proportion of the tube being located within the retention chamber, and with the tube being composed of a material having a high thermal conductivity, whereby gases retained in the retention chamber are heated at least partly by direct heating from contact with the tube in the retention chamber.

2. A cremator according to claim 1, wherein the thermally conductive material of the secondary combustion tube is silicon carbide.

3. A cremator according to claim 1, further comprising means including the first and second burners for maintaining the interior of the retention chamber during operation at a temperature of at least 850° C.

4. A cremator according to claim 1, wherein the retention chamber is located above the primary combustion chamber, with the secondary combustion tube being supported at said one end thereof such that substantially the whole length of the tube is located within the retention chamber in order to maximize the use of heat generated within it to heat the waste gases temporarily retained in the retention chamber.

5. A cremator according to claim 4, wherein the retention chamber is provided with air inlet means via which clean air may be introduced into the retention chamber to control throughflow of the waste gases through the retention chamber.

6. A cremator according to claim 5, wherein the air inlet means is positioned so that the entering clean air opposes the waste gases entering the retention chamber from said opposite end of the tube of the secondary combustion chamber and thereby causes the waste gases to turn around and flow back over the exterior surface of the tube to the waste flue.

7. A cremator according to claim 6, wherein the waste flue is located adjacent said one end of said tube.

8. A cremator according to claim 7, further comprising second air inlet means in the waste flue for controlling the throughflow rate of the waste gases.

* * * * *